US008440928B2

(12) United States Patent
Hisamune et al.

(10) Patent No.: US 8,440,928 B2
(45) Date of Patent: May 14, 2013

(54) ROTARY ELECTRONIC COMPONENT

(75) Inventors: Hiroaki Hisamune, Okayama (JP); Akira Matsumoto, Okayama (JP)

(73) Assignee: Panasonic Corporation, Osaka (JP)

( * ) Notice: Subject to any disclaimer, the term of this patent is extended or adjusted under 35 U.S.C. 154(b) by 276 days.

(21) Appl. No.: 12/952,258

(22) Filed: Nov. 23, 2010

(65) Prior Publication Data

US 2011/0132112 A1 Jun. 9, 2011

(30) Foreign Application Priority Data

Dec. 7, 2009 (JP) ..... 2009-277282

(51) Int. Cl.
*H01H 19/58* (2006.01)

(52) U.S. Cl.
USPC ..... 200/564; 200/565

(58) Field of Classification Search ... 200/4, 11 R–11 H, 200/564, 565, 567, 570, 571, 336; 341/22, 341/27, 35; 345/156, 168, 169, 184
See application file for complete search history.

(56) References Cited

U.S. PATENT DOCUMENTS

| | | | | |
|---|---|---|---|---|
| 3,230,793 | A * | 1/1966 | Allison | 74/527 |
| 3,584,163 | A * | 6/1971 | White | 200/11 G |
| 4,719,324 | A * | 1/1988 | Kuratani | 200/11 R |
| 4,855,541 | A * | 8/1989 | Yamashita et al. | 200/6 R |
| 6,365,849 | B1 * | 4/2002 | Ono | 200/14 |
| 6,506,984 | B2 * | 1/2003 | Tomita | 200/11 R |
| 7,423,230 | B2 * | 9/2008 | Yoritsune et al. | 200/565 |
| 2009/0184848 | A1 * | 7/2009 | Sugahara et al. | 341/11 |

FOREIGN PATENT DOCUMENTS

| | | |
|---|---|---|
| CN | 1347128 | 5/2002 |
| CN | 201069729 | 6/2008 |
| CN | 101211706 | 7/2008 |
| JP | 2002-110001 | 4/2002 |
| JP | 2003-115237 | 4/2003 |
| JP | 2006-079966 | 3/2006 |
| JP | 2007-194008 | 8/2007 |
| JP | 2008-166158 | 7/2008 |

* cited by examiner

*Primary Examiner* — Michael Friedhofer
(74) *Attorney, Agent, or Firm* — Wenderoth, Lind & Ponack, LLP.

(57) ABSTRACT

In a rotary electronic component, the rotor includes a flange with the first face on which grooves are formed radially and the second face. The plate spring with a ring shape in the top view, includes resilient arms and flat parts. The upper member has the bottom face covering the plate spring and the first face, and retains the flat part such that the flat part can be attached to or detached from the bottom face of the upper member while preventing the plate spring from rotating responsive to rotation of the rotor. A spring constant of the resilient arms and the shape of the flat part are set to achieve the state such that the resilient, arms bend and the flat part is partially released from the bottom face of the upper member when the resilient arms go over a position between adjacent grooves.

5 Claims, 7 Drawing Sheets

ROTARY ELECTRONIC COMPONENT

BACKGROUND OF THE INVENTION

1. Field of the Invention

The present invention relates to a rotary electronic component used for forming input operation portions of various electronic devices.

2. Background Art

An increasing number of rotary electronic components are being mounted in input operation parts of a range of electronic devices. A conventional rotary electronic component is described below with reference to FIGS. 5 to 7. FIGS. 5 and 6 are a sectional view and an exploded perspective view of a conventional rotary electronic component, respectively. FIG. 7 is a perspective view illustrating a state of assembly of a plate spring and an upper case, which are key parts of the rotary electronic component. This rotary electronic component includes lower case 71 formed of insulating resin, rotor 75 made of insulating resin, rotary contact plate 85, upper case 90, metal cover 95, and plate spring 100.

Multiple resilient contacts 73 are attached by insert-molding to the inner bottom face of the cavity of a box-shaped lower case 71 with an open top. Rotor 75 includes columnar operating shaft 76, and round flange 78 integrally provided on a bottom part of operating shaft 76. Flange 78 is housed in the cavity, and rotor 75 is rotatably supported by the inner bottom face of cavity of lower case 71.

Rotary contact plate 85 is configured with conductive metal plates of predetermined patterns, and fixed on the bottom face of flange 78 of rotor 75. Each resilient contact 73 is provided such that it makes resilient contact with rotary contact plate 85. Multiple grooves 80 are formed radially on the top face of flange 78.

Upper case 90 is disposed over lower case 71. Upper case 90 has cylindrical bearing 91 protruding upward at the center thereof. Operating shaft 76 of rotor 75 is inserted through bearing 91, and rotatably retained by the inner circumferential face of bearing 91. Cover 95 is mounted over upper case 90, and its leg parts are caulked to the bottom face of lower case 71 so as to integrate upper case 90 and lower case 71.

Plate spring 100 for generating a clicking feedback is ring-shaped in the top view. Each resilient arm 101 extending in an arc shape is bent at its center to form protrusion 102 having a U-shape and protruding downward.

Flat part 103 is provided between resilient arms 101 of plate spring 100. Each of flat parts 103 is provided with through hole 104. Caulking protrusion 92 provided on the bottom face of upper case 90 shown in FIG. 7 is inserted into each through hole 104. The bottom face of upper case 90 is overlaid on the top faces of two flat parts 103. Then, as shown in FIG. 5, the bottom end of each caulking protrusion 92 is deformed and broadened. This deformation makes plate spring 100 firmly attached onto upper case 90. In this attached state, the bottom face of each protrusion 102 resiliently contacts the inner face of groove 80.

In the conventional rotary electronic component as configured above, rotary contact plate 85 attached onto flange 78 rotates to move relative to multiple resilient contacts 73 when rotor 75 is rotated by rotating operating shaft 76. This outputs a predetermined signal. At the same time, the user is aware of a predetermined clicking feedback when protrusion 102 of plate spring 100 goes over the position between grooves 80, and is fitted in the next groove 80.

As described above, the conventional rotary electronic component gives good clicking feedback that offers ease of operation. However, there still remains a strong demand from product manufacturers for the development of rotary electronic components with better usability. There is particularly strong demand for the development of specifications that confirm the operation state in ways other than the clicking feedback.

SUMMARY OF THE INVENTION

The present invention is a rotary electronic component that gives a clicking feedback while simultaneously generating sound. The rotary electronic component of the present invention includes a rotor, a plate spring, an upper member, and a rotary element unit. The rotor includes a flange that has a first face and a second face. Multiple grooves are formed radially on the first face of the flange. The plate spring, which has a ring shape when seen from the top, includes resilient arms and flat parts. At least one of the resilient arms resiliently contacts the first face of the flange. The resilient arm has an arc shape when seen from the top, and is inclined downward. The flat part is provided between two adjacent ones of the resilient arms. The rotary element unit outputs a signal in response to the rotation of the rotor. The upper member has the bottom face covering the plate spring and the first face of the flange. The upper member retains the flat part of the plate spring such that the flat part can be attached to and detached from the bottom face of the upper member, while also preventing any rotation of the plate spring being caused by rotation of the rotor. The spring constant of the resilient arms and the shape of the flat part are set to achieved the state such that the resilient arms bend and at the same time the flat part is partially released from the bottom face of the upper member when the resilient arms move over the position between the adjacent grooves formed on the first face of the flange. With this simple structure, the rotary electronic component of the present invention gives a clicking feedback while simultaneously generating sound because the flat part strikes the bottom face of the upper member. The user can thus readily understand the operation state due to both tactile feedback and sound.

DETAILED DESCRIPTION OF THE INVENTION

Figure 1:
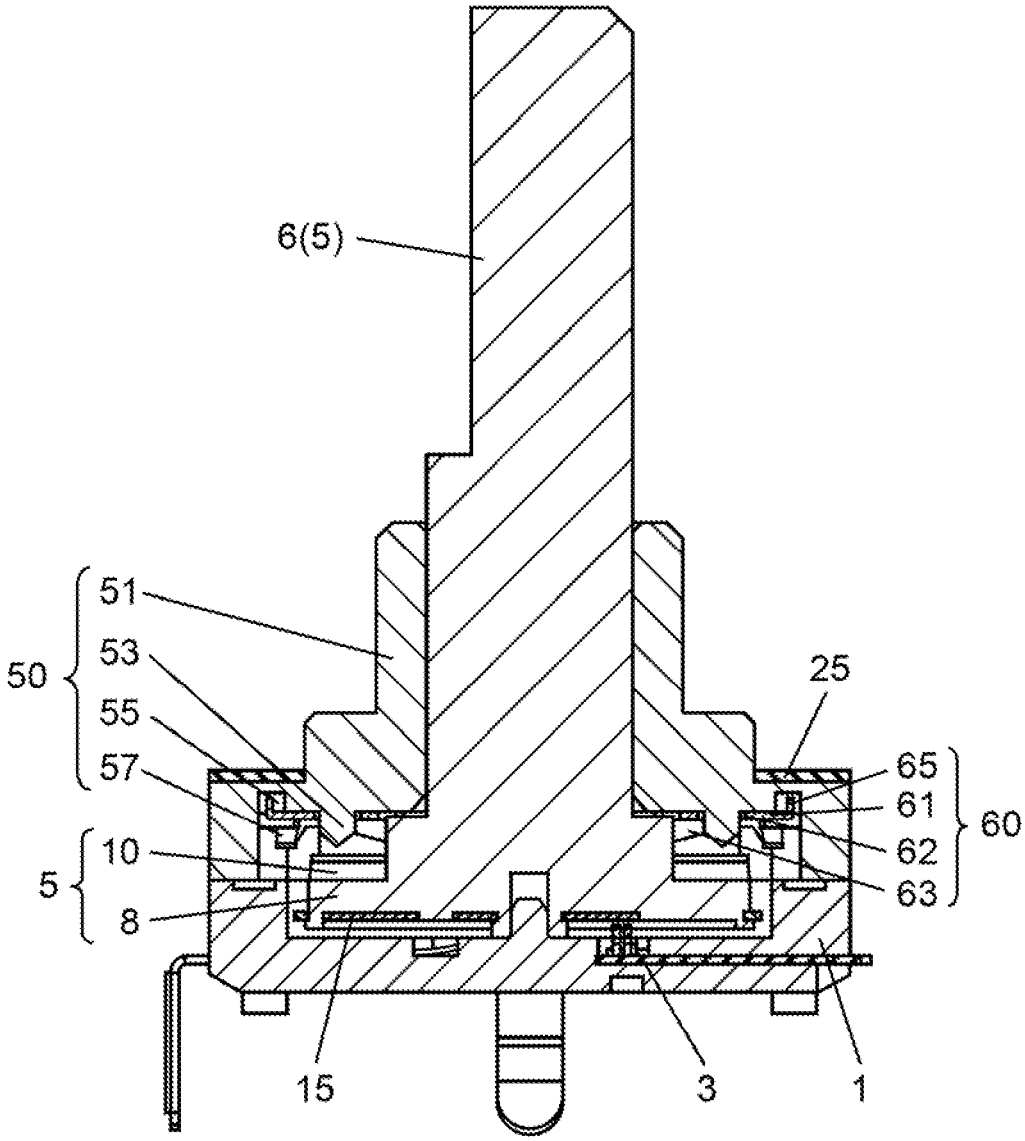
FIG. 1 is a sectional view of a rotary electronic component in accordance with an exemplary embodiment of the present invention.
Figure 2:
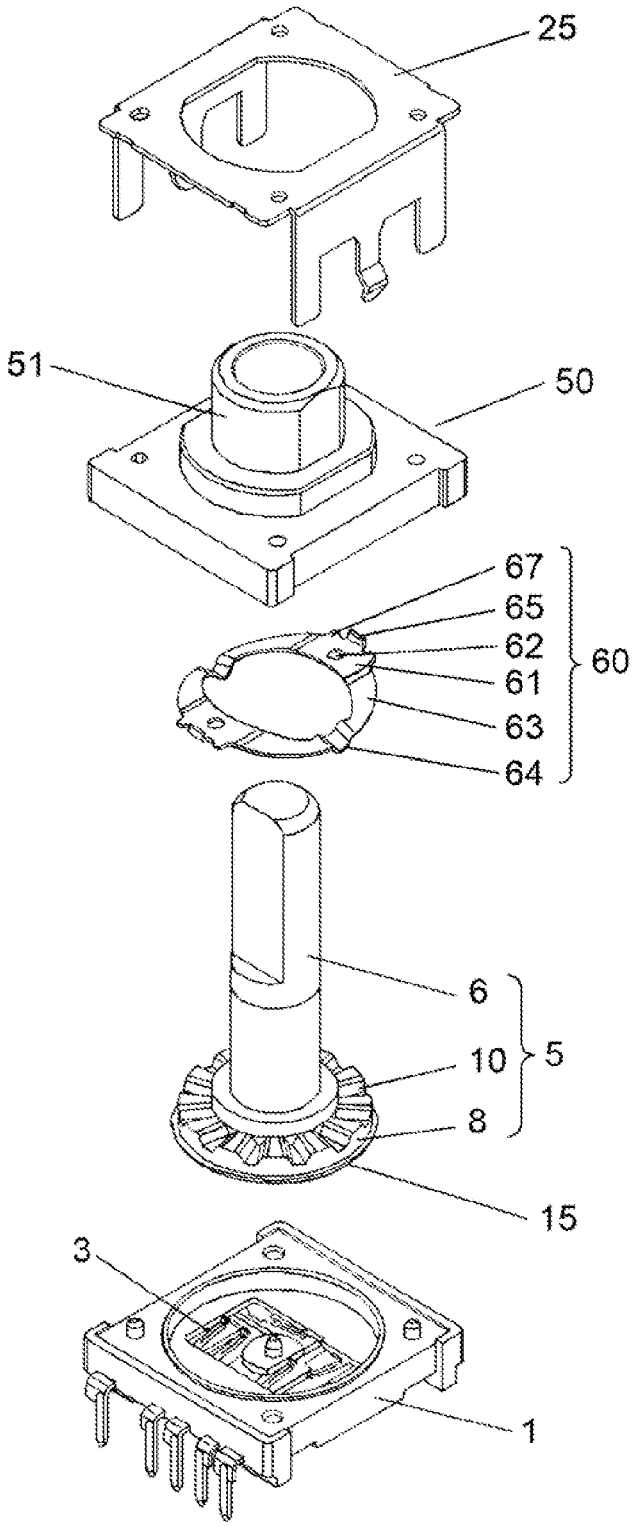
FIG. 2 is an exploded perspective view of the rotary electronic component shown in FIG. 1.
Figure 3:
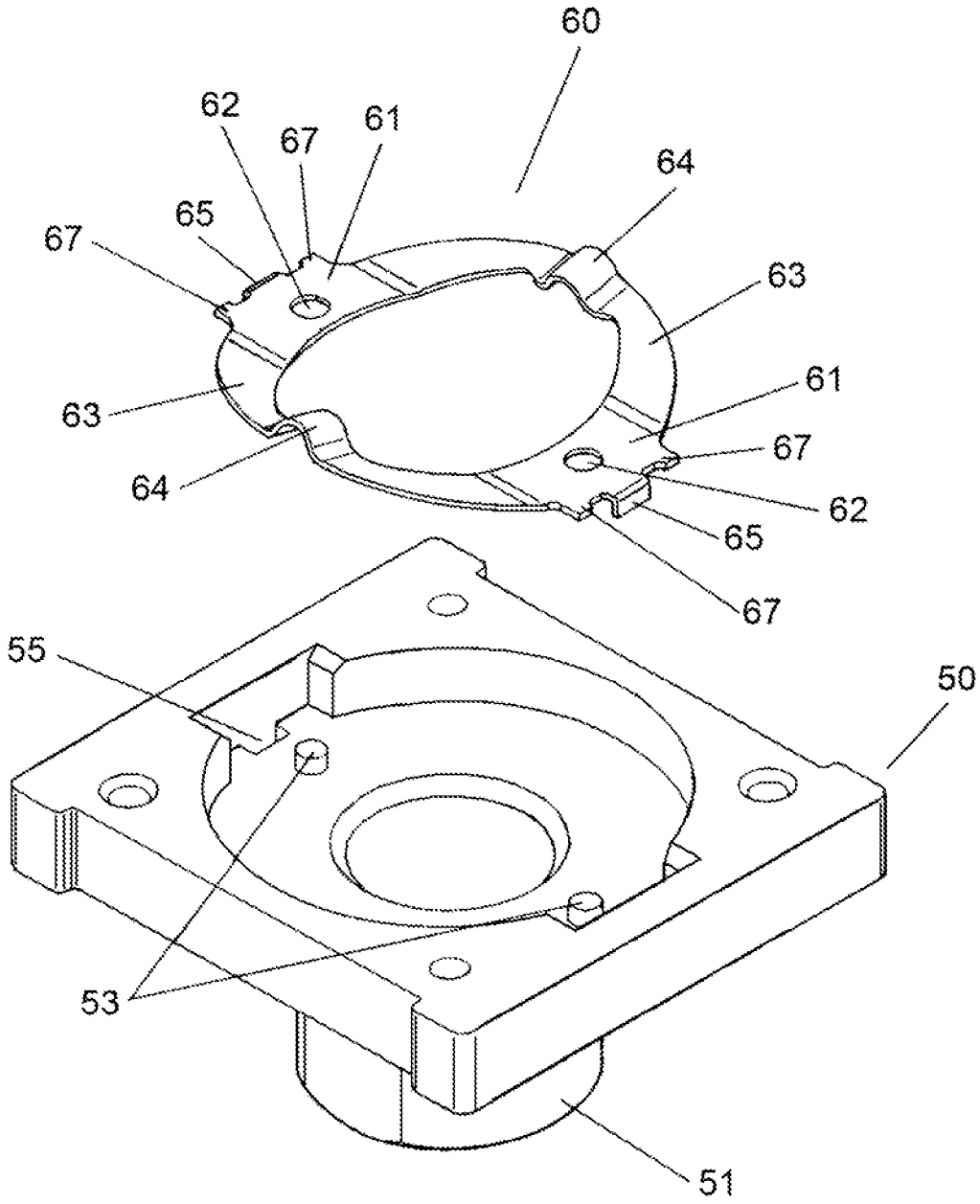
FIG. 3 is a perspective view of a state of assembly of a plate spring and an upper case, which are key parts of the rotary electronic component shown in FIG. 1.

FIGS. 1 and 2 are a sectional view and an exploded perspective view of a rotary electronic component in an exemplary embodiment of the present invention, respectively. FIG. 3 is a perspective view of a state of assembly of a plate spring and an upper case, which are key parts of the rotary electronic component. This rotary electronic component includes rotor 5, plate spring 60, upper case 50 that is an upper member, lower case 1, metal cover 25, and a rotary element unit that includes multiple resilient contacts 3 and rotary contact plate 15.

Lower case 1 is made of insulating resin, and is box-shaped with an open top. Multiple resilient contacts 3 are fixed by insert-molding to the inner bottom face of a cavity of lower case 1. Rotor 5 includes cylindrical operating shaft 6, and round flange 8 integrally provided with operating shaft 6 at the bottom part of operating shaft 6. Flange 8 is housed in the cavity, and rotor 5 is rotatably supported by the inner bottom face of the cavity of lower case 1. Rotary contact plate 15 is fixed on the bottom face of flange 8, and each resilient contact 3 is disposed such that it makes resilient contact with rotary contact plate 15. Rotary contact plate 15 is configured with metal plates formed of predetermined patterns. Multiple grooves 10 are formed radially on the top face of flange 8.

Upper case 50 is placed over lower case 1. Upper case 50 has cylindrical bearing 51 protruding upward at the center thereof. Operating shaft 6 of rotor 5 is inserted into bearing 51, and is rotatably retained by the inner circumferential face of bearing 51. Cover 25 is mounted over upper case 50, and its leg parts are caulked to the bottom face of lower case 1 so as to integrate upper case 50 and lower case 1.

Plate spring 60, which has a ring shape when seen from the top, includes two resilient arms 63 and two flat parts 61. Resilient arms 63 have an arc shape when seen from the top, and are inclined downward from flat part 61. Each resilient arm 63 is bent to form a U-shape protruding downward, namely protrusion 64, at its center. Flat part 61 is provided between resilient arms 63.

Plate spring 60 is formed by punching out a sheet of resilient metal plate corresponding to the above shape, and then formed into the above shape by predetermined bending. As long as the plate spring has the above shape, a conventional spring can also be used as plate spring 60. In this case, however, setting conditions such as spring constant, which is described later, need to be fulfilled. Each protrusion 64 is fitted into one of grooves 10 provided radially on the top face of flange 8 of rotor 5 in the state that each resilient arm 63 is slightly bent.

In addition, flat part 61 of plate spring 60 is provided with through hole 62. On the other hand, upper case 50 has two protrusions 53 protruding from its bottom face. Each protrusion 53 is inserted into through hole 62 formed in flat part 61 of plate spring 60. However, protrusion 53 is not deformed. Therefore, the top face of flat part 61 of plate spring 60 resiliently contacts the bottom face of upper case 50 by the force of each resilient arm 63. Each flat part 61 is thus not fixed to upper case 50. In other words, upper case 50 retains flat part 61 of plate spring 60 such that flat part 61 can be attached to or detached from the bottom face of upper case 50, while also preventing plate spring 60 from rotating responsive to rotation of rotor 5.

As long as flat part 61 is not fixed to upper case 50, a tip of protrusion 53 may be deformed to prevent protrusion 53 from coming out of through hole 62. This structure allows completion of the rotary electronic component by placing plate spring 60 on reversed upper case 50, deforming the tip of protrusion 53 without making flat part 61 fixed, and then assembling with lower case 1.

As described above, each flat part 61 of plate spring 60 is not fixed onto the bottom face of upper case 50. However, since protrusion 53 is inserted in through hole 62, the rotation of plate spring 60 is restricted.

Plate spring 60 further has upward bend 65 that is a portion bent upward on an outer rim of flat part 61 for restricting rotation. As shown in FIG. 3, two holes 55 dented upward for inserting each upward bend 65 are provided on the bottom face of upper case 50. Each upward bend 65 of plate spring 60 is inserted into each corresponding hole 55. Also with this structure, upper case 50 retains flat part 61 such that flat part 61 of plate spring 60 can be attached to and detached from the bottom face of upper case 50, while preventing any rotation of plate spring 60 being caused by rotation of rotor 5. Only one of the structures described above may be adopted as detailed structure for restricting any rotation of plate spring 60. Alternatively, other structures may be adopted to restrict the rotation of plate spring 60. For example, flat part 61 of plate spring 60 preferably has outward protrusions 67 protruding outward in the radial direction on the same face next to both sides of each upward bend 65.

Figure 4:
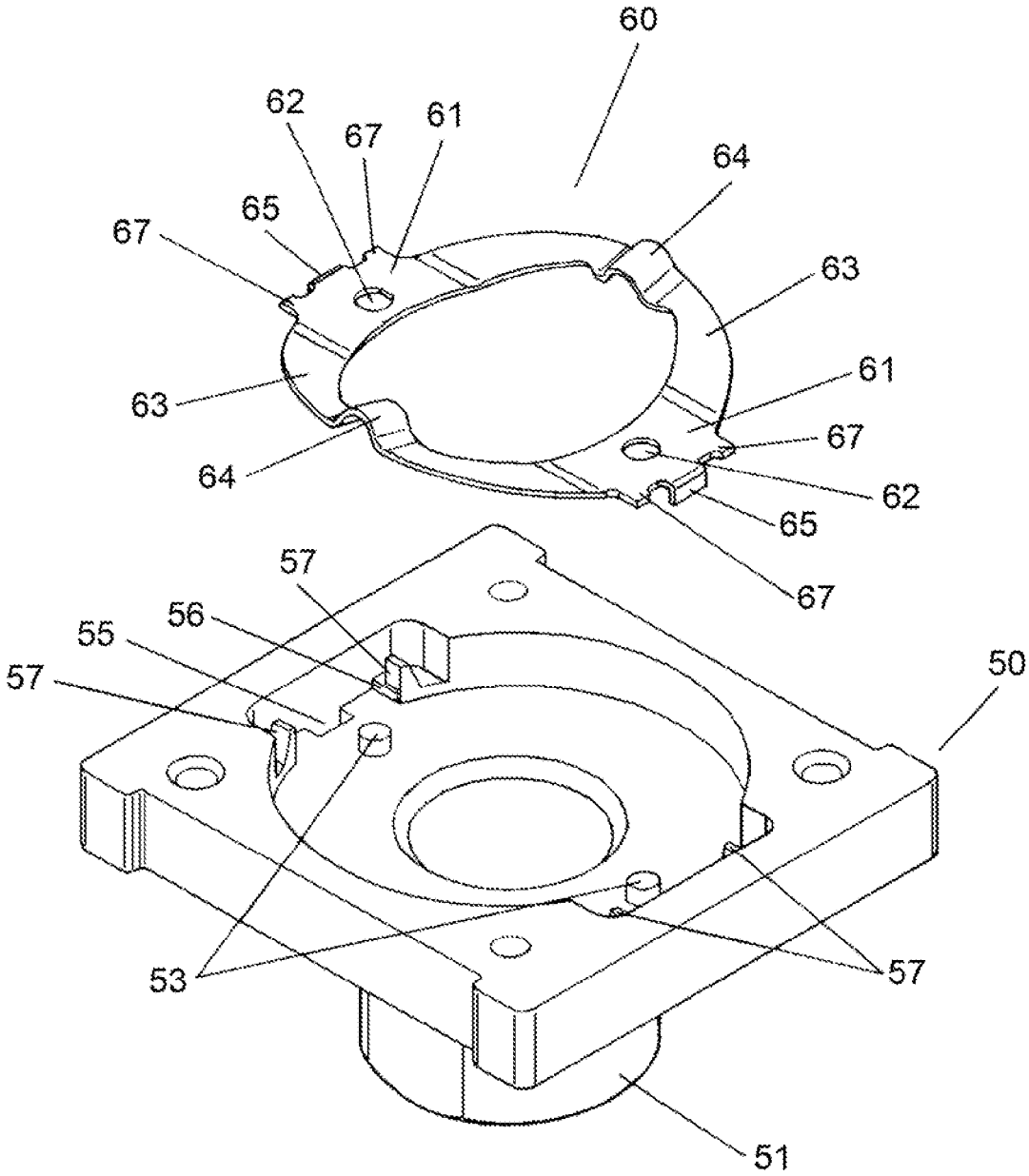
FIG. 4 is a perspective view showing an upper case with a shape different from that in FIG. 3.
Figure 5:
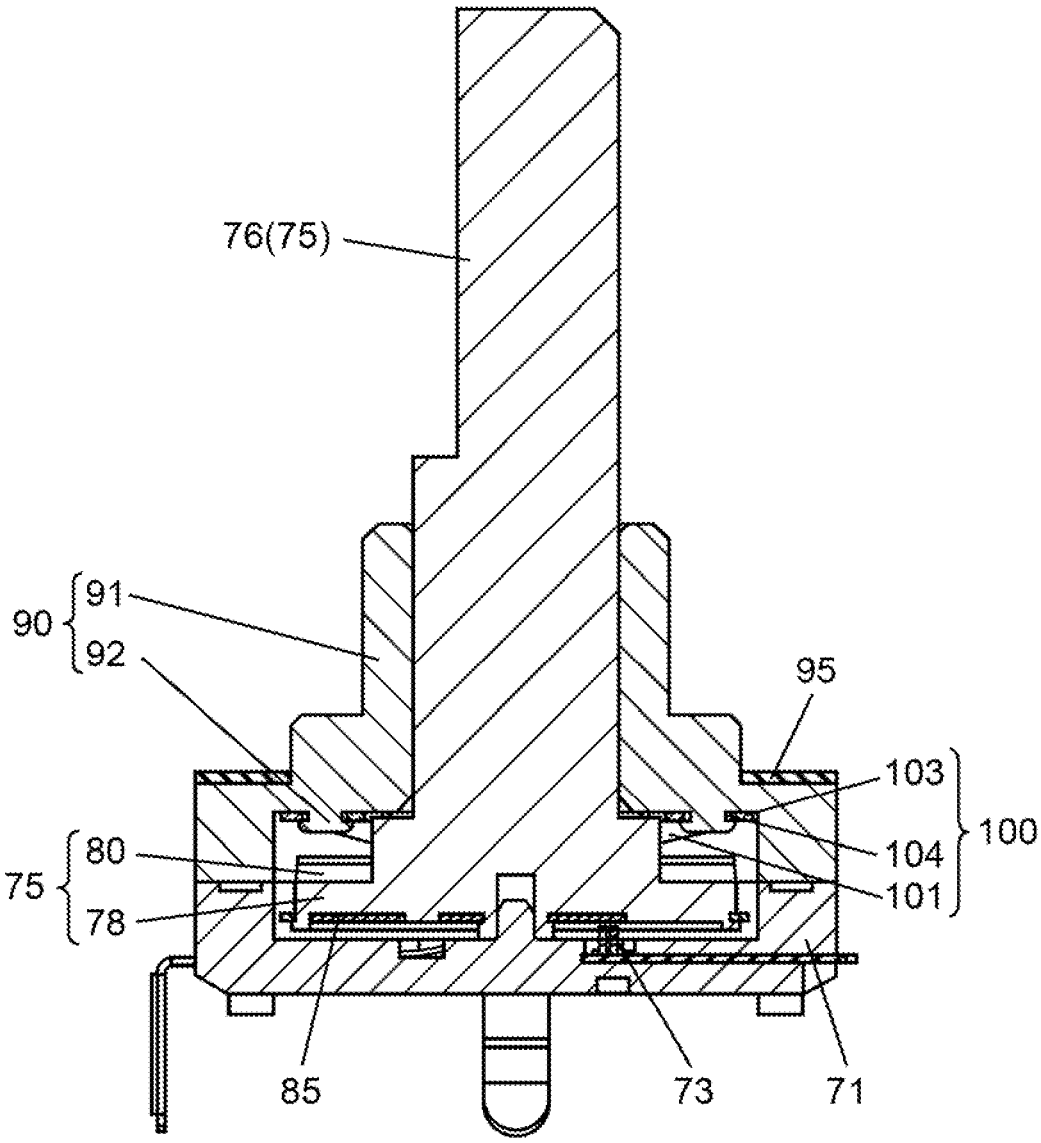
FIG. 5 PRIOR ART
FIG. 5 is a sectional view of a conventional rotary electronic component.
Figure 6:
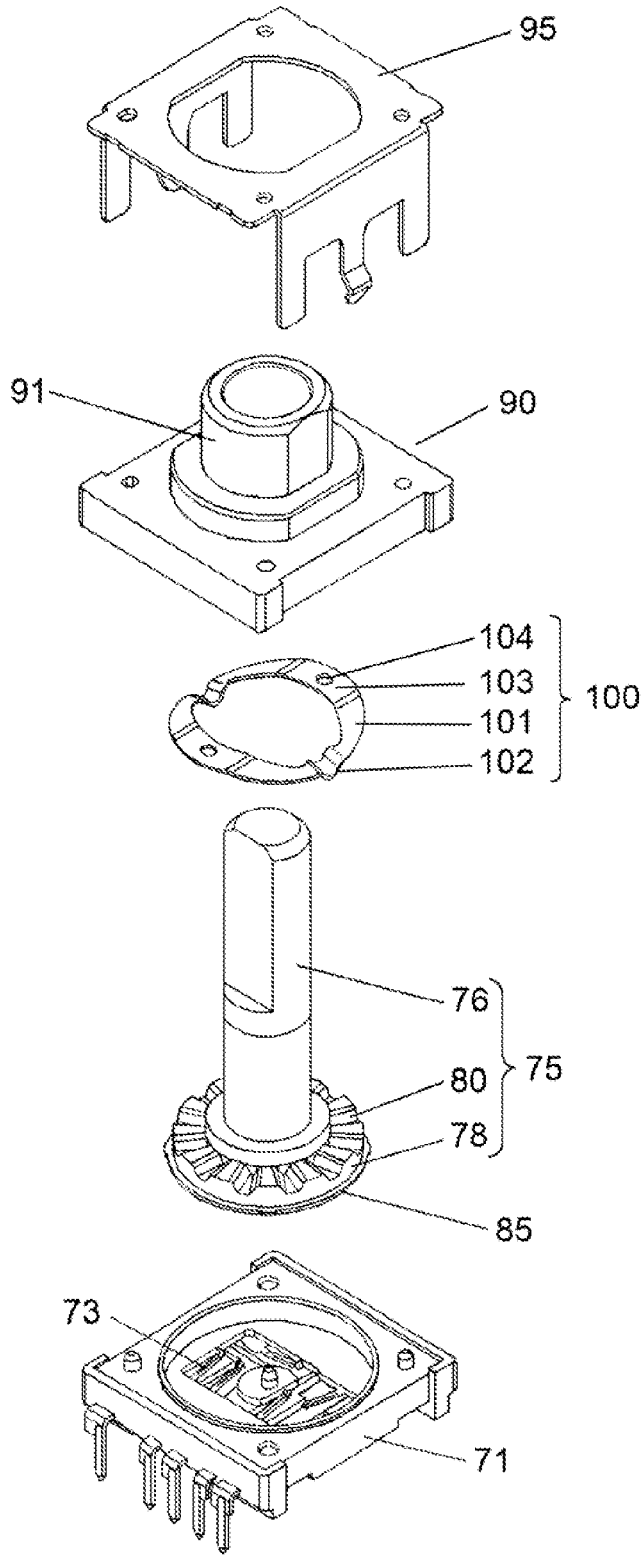
FIG. 6 PRIOR ART
FIG. 6 is an exploded perspective view of the rotary electronic component shown in FIG. 5.
Figure 7:
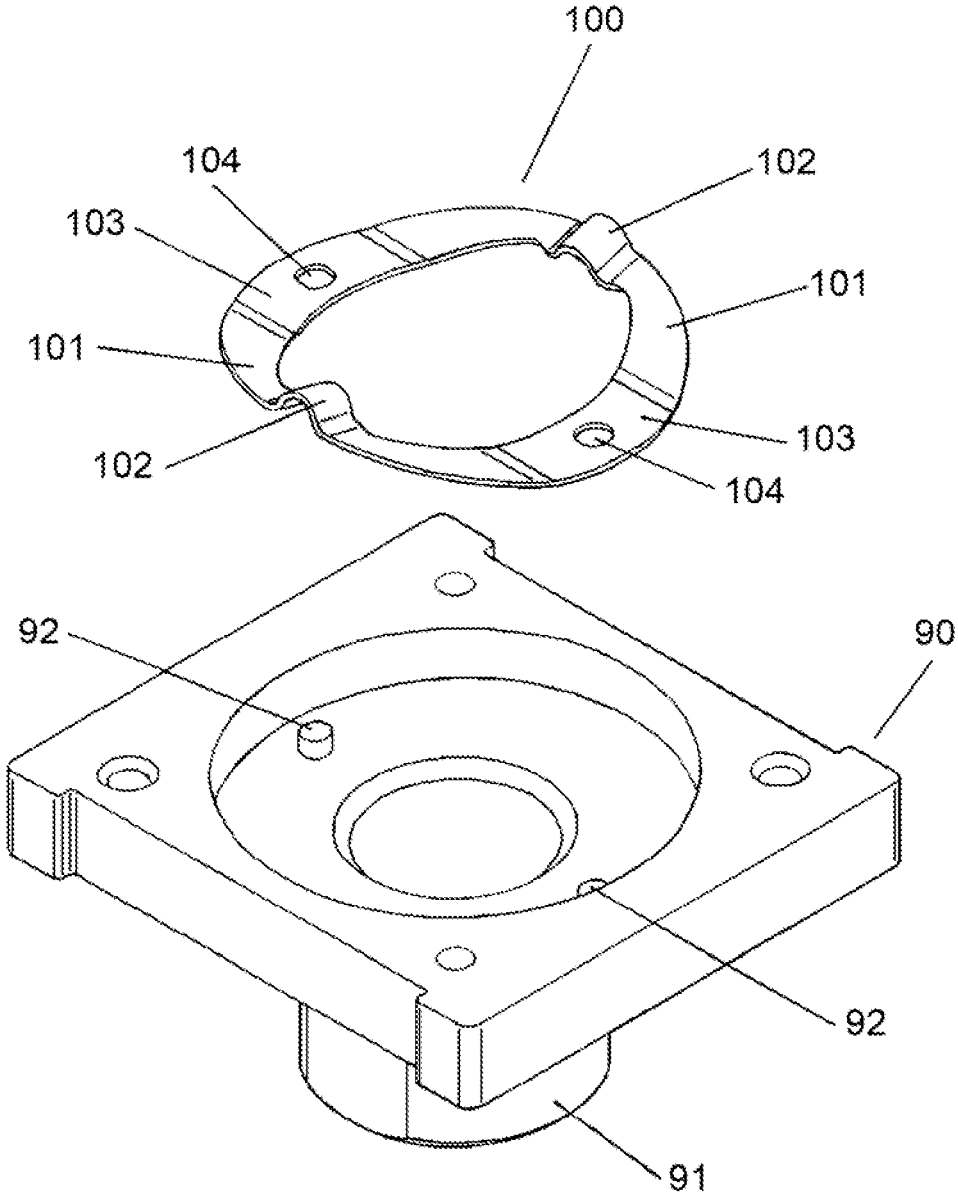
FIG. 7 PRIOR ART
FIG. 7 is a perspective view of a state of assembly of a plate spring and an upper case, which are key parts of the rotary electronic component shown in FIG. 5.

Still more, as shown in FIG. 4, upper case 50 preferably includes lower steps 56 with a predetermined height provided at both sides of hole 55 at positions corresponding to outward protrusions 67, and stopper tabs 57 each protruding downward from the bottom face of lower step 56.

In assembly of the rotary electronic component, an operator places plate spring 60 on upper case 50 held upside down. Then, stopper tabs 57 are slightly tilted inward without fixing flat part 61. This forms an integrated work-in-process in which plate spring 60 is not fixed but prevented from removal. By providing lower step 56, flat part 61 of plate spring 60 can be retained without being fixed even if the base of stopper tab 57 expands upon tilting stopper tab 57 inward. Then, the rotary electronic component is completed by combining with lower case 1 and the other parts. These outward protrusions 67 and stopper tabs 57 can improve productivity.

It is important to set an appropriate height for lower step 56 and sufficiently control the state of tilted stopper tab 57 in order to prevent tilted stopper tab 57 from making contact with plate spring 60 after completing the rotary electronic component, including during operation.

The operation of the rotary electronic component as configured above is described below. When a user rotates operating shaft 6 protruding upward, rotor 5 rotates. In line with this rotation, rotary contact plate 15 fixed to flange 8 rotates relative to multiple resilient contacts 3. This outputs a predetermined signal. Since movement of plate spring 60 in the rotating direction is restricted, each protrusion 64 goes over a position between grooves 10 and fits into next groove 10 at the same time as this signal output. This movement thus clearly gives the user a predetermined clicking feedback.

Next, setting of spring constant for aforementioned plate spring 60 is described. In the above rotating operation, resilient arms 63 bend upward as each protrusion 64 of plate spring 60 goes over the position between adjacent two of grooves 10. As resilient arms 63 bend in this way, unfixed flat parts 61 are partially released downward from the bottom face of upper case 50 by the force of resilient arms 63. The spring constant of resilient arms 63 is set to achieve this state. The shape of flat part 61 is also set such that it encourages transition of flat part 61 to that state. For example, an outline shape between upward bend 65 and outward protrusion 67 is slightly dented. Or, the thickness of material of plate spring 60 is appropriately selected so that transition to the aforementioned state is feasible.

More specifically, dimensions of flat part 61 are about 3.2 mm in the radial direction and about 5 mm in the circumferential direction. The width at the base of resilient arm 63 is about 2.5 mm, and the width at the tip is about 1.5 mm. The circumferential length of resilient arm 63 from the base to protrusion 64 is about 7 mm, the inclination length in a side view is about 3.5 mm, and the length to the tip is about 4.2 mm. The downward inclination shape of resilient arm 63 has about 30° of bending angle in the manufactured state, and about 14° of inclination angle toward groove 10 in the use state. When the spring constant is set to about 5.6 N/mm in this shape, the aforementioned movement becomes feasible.

As resilient arms 63 bend upward, each flat part 61 is partially released downward from the bottom face of upper case 50. Then, when protrusion 64 of resilient arm 63 is fitted into the adjacent next groove 10, bending of resilient arm 6 is suddenly canceled. In response to this action, flat part 61 suddenly returns to the original state of resiliently touching (contacting) the bottom face of upper case 50. At this point, flat part 61 strikes the bottom face of upper case 50, and a hitting sound is generated. The level and quality of the hitting sound are affected by shapes and materials of plate spring 60 and upper case 50. Therefore, their shapes and materials are appropriately set to gain a required sound.

If no upward bend 65 is provided, the width of metal material of flat part 61 where through hole 62 is created is practically equivalent to the width subtracting the diameter of through hole 62 from the width of flat part 61. In other words, flat part 61 is considered to have partially a narrow width. This is preferable because transition of flat part 61 during movement is encouraged. Other than through hole 62, a narrow portion may be formed in flat part 61 such as by providing a notch on the outer circumference or inner circumference of flat part 61.

In a case that plate spring 60 has two resilient arms 63, transition of each flat part 61 is large, and thus the hitting sound preferably becomes large. However, a structure in which protrusion 64 that fits into groove 10 is provided only on one of two resilient arms, and the other flat resilient arm resiliently slides on flange 8 may also be adopted.

Flat part 61 is preferably provided at two opposing positions. Protrusions 64 of resilient arms 63 are preferably provided at opposing positions. In other words, resilient, arms 63 preferably have the same shape, including the shape of protrusion 64, and the same spring constant. Flat parts 61 also preferably have the same shape. Identical resilient arms 63 are preferable because they encourage transition of flat parts 61. In addition, multiple protrusions 64 of resilient arms 63 are preferably fitted into different grooves of grooves 10 at the same time. This increases hitting sound level.

The above description refers to plate spring 60 that has two resilient arms 63 and two flat parts 61. However, plate spring 60 may have three or more of them, respectively, depending on the size of plate spring 60. Also in this case, resilient arms 63 preferably have the same shape and the same spring constant, and these resilient arms 63 are fitted into different grooves of grooves 10 at the same time.

The above description refers to the rotary element unit configured with fixed resilient contact 3 and rotary contact plate 15 as an example of the structure of rotary contact. However, the rotary element unit may have other structures. For example, a brush or contact piece is fixed on the bottom face of rotor 5, and this brush or contact piece resiliently slides on the element or conductive pattern provided on the inner bottom face of lower case 1. Alternatively, non-contact structure may be adopted. In this structure, a magnet is provided in rotor 5 and a magnetic detector element detects a change in magnetism generated in response to rotation, for example. An optical structure can also be adopted. Furthermore, the concept of the structure of the present invention may be applied to a rotary electronic component with a push-switch structure.

As described above, the present invention requires rotor 5, plate spring 60, and upper case 50, which is an upper member. Therefore, the present invention is also applicable to those other than independent finished rotary electronic components. More specifically, a wiring board may be provided instead of lower case 1. Or, a casing of a unit product may be used as the upper member, instead of upper case 50.

Furthermore, flat part 61 of plate spring 60 may be installed in rotor 5. In other words, the positional relation of plate spring 60 and groove 10 may be reversed. In this case, flat part 61 of plate spring 60 is placed on the top face of flange 8 of rotor 5. Resilient arm 63 is bent in an upward-inclining manner. Grooves 10 are created in the bottom face of upper case 50, and resilient arms 63 resiliently make contact with the bottom face of upper case 50. This structure also achieves the same effect as that shown in FIGS. 1 to 3.

In the exemplary embodiment, upper case 50 is fixed to lower case 1 using cover 25. However, the fixing method is not limited to this method. For example, upper case 50 can be fixed to lower case 1 using a screw passing through upper case 50.

As described above, the rotary electronic component in this exemplary embodiment includes rotor 5, plate spring 60, upper case 50, which is an upper member, and the rotary element unit inducing resilient contact 3 and rotary contact plate 15.

Rotor 5 includes the flange with the top face that is the first face, and the bottom face that is the second face. Multiple grooves 10 are radially formed on the top face of flange 8. Plate spring 60 with a ring shape in a top view includes multiple resilient arms 63 and flat parts 61. Each resilient arm 63 is formed in an arc shape inclining downward in a top view. At least one of resilient arms 63 is resiliently contacting the top face of flange 8 where grooves 10 are formed. Flat part 61 is provided between resilient arms 63. In the example shown in FIG. 2, plate spring 60 has two resilient arms 63 and two flat parts 61, respectively.

Upper case 50 has the bottom face covering plate spring 60 and the top face of flange 8. Upper case 50 retains flat part 61 of plate spring 60 such that flat part 61 can be attached to and detached from the bottom face of upper case 50, while preventing any rotation of plate spring 60 being caused by rotation of rotor 5. The rotary element unit configured with resilient contact 3 and rotary contact plate 15 outputs a signal in response to the rotation of rotor 5.

When resilient arms 63 go over the position between adjacent grooves 10 formed on the top face of flange 8, resilient arms 63 bend. At the same time, flat parts 61 are partially released from the bottom face of upper case 50. The spring constant of resilient arms 63 and the shape of flat parts 61 are set to achieve this state.

With this structure, the present invention achieves the rotary electronic component that gives a clicking feedback and also generates sound (hitting sound) at the same time when operated. The hitting sound is generated at each clicking position. In other words, the sound is generated in sync with the tactile feedback. The user can thus readily understand the operation state due to both tactile feedback and sound.

As described above, the present invention offers the rotary electronic component that gives a clicking feedback while at the same time generating sound when operated. The present invention is thus effectively applicable to structures of input operation portions of various electronic devices.

What is claimed is:

1. A rotary electronic component comprising:

a rotor including a flange with a first face and a second face, a plurality of grooves being formed radially on the first face of the flange;

a plate spring with a ring shape in a top view, the plate spring including:

a plurality of resilient arms with an arc shape in the top view, the resilient arms having a shape inclining downward, at least one of the resilient arms resiliently contacting the first face of the flange; and a flat part provided between adjacent resilient arms of the resilient arms;

an upper member with a bottom face covering the plate spring and the first face of the flange; and a rotary element unit outputting a signal in response to rotation of the rotor;

wherein the upper member retains the flat part of the plate spring such that the flat part can be attached to and detached from the bottom face of the upper member while preventing the plate spring from rotating responsive to rotation of the rotor; and wherein a spring constant of the resilient arms and a shape of the flat part are set to achieve a state such that the resilient arms bend and at a same time the flat part is partially released from the bottom face of the upper member when the resilient arms go over a position between adjacent grooves of the plurality of grooves formed on the first face of the flange.

2. The rotary electronic component according to claim 1, wherein the resilient arms of the plate spring have a same shape and a same spring constant, and the resilient arms of the plate spring are fitted into different grooves of the plurality of grooves formed on the first face of the flange at a same time.

3. The rotary electronic component according to claim 1, wherein stopper tabs are provided on the upper member, the stopper tabs retaining the flat part of the plate spring such that the flat part can be attached to and detached from the bottom face of the upper member.

4. The rotary electronic component according to claim 1, wherein the upper member has a protrusion protruding from the bottom face, and the flat part of the plate spring is provided with a through hole for inserting the protrusion.

5. The rotary electronic component according to claim 1, wherein the plate spring further includes an upward bend that is a portion bent from the flat part toward the upper member; and the bottom face of the upper member is provided with a hole for housing the upward bend.

* * * * *